US007152562B2

(12) United States Patent
Anderson

(10) Patent No.: US 7,152,562 B2
(45) Date of Patent: Dec. 26, 2006

(54) MOTORCYCLE TIMING ADJUSTMENT

(76) Inventor: Rod Anderson, 17461 147th St. SE. #21, Monroe, WA (US) 98272

( * ) Notice: Subject to any disclaimer, the term of this patent is extended or adjusted under 35 U.S.C. 154(b) by 0 days.

(21) Appl. No.: 11/142,050

(22) Filed: May 31, 2005

(65) Prior Publication Data

US 2006/0266321 A1 Nov. 30, 2006

(51) Int. Cl.
*F02P 7/06* (2006.01)

(52) U.S. Cl. ..... 123/146.5 A; 123/612

(58) Field of Classification Search ..... 123/146.5 A, 123/595, 612–617; 324/391; 200/19.11, 200/19.19, 19.22–19.24, 19.31
See application file for complete search history.

(56) References Cited

U.S. PATENT DOCUMENTS

| | | | | |
|---|---|---|---|---|
| 4,951,629 | A * | 8/1990 | McAbee et al. | 123/613 |
| 5,431,134 | A * | 7/1995 | Budde et al. | 123/146.5 A |
| 5,921,211 | A * | 7/1999 | Salvisberg | 123/146.5 A |
| 6,388,446 | B1 * | 5/2002 | Nielsen et al. | 324/391 |
| 6,505,606 | B1 * | 1/2003 | Lodise et al. | 123/406.21 |

* cited by examiner

*Primary Examiner*—T. M. Argenbright
(74) *Attorney, Agent, or Firm*—Christensen O'Connor Johnson Kindness[PLLC]

(57) ABSTRACT

A motorcycle engine's ignition system controls the spark that ignites the fuel in a cylinder. The ignitition system routes high-voltage pulses to individual cylinders of a motorcycle engine in the correct sequence and with precise timing. A timing structure is provided that allows timing adjustment to be made externally without the invasive procedures used in a motorcycle shop.

15 Claims, 5 Drawing Sheets

MOTORCYCLE TIMING ADJUSTMENT

FIELD OF THE INVENTION

The present invention relates generally to motorcycle ignition systems, and more particularly, to adjusting the timing to various cylinders of a motorcycle combustion engine.

BACKGROUND OF THE INVENTION

A motorcycle is a two-wheeled automotive vehicle having one or two saddles. German inventor Gottlieb Daimler created the first motorcycle in 1885. Various models were introduced in Europe in subsequent years in an attempt to turn the motorcycle into a transportation vehicle. In 1903, American inventor William Harley, his neighbor Arthur Davidson, and Davidson's brothers, Walter and William, built the first Harley-Davidson motorcycle. Very soon after, Harley-Davidson began manufacturing motorcycles for sale, and in 1909 they introduced the first V-twin engine, comprising two cylinders arranged in a distinctive "V" angle. The engine, which produced a deep, rumbling sound, soon symbolized the classic American motorcycle engine.

There are six major parts of a motorcycle. These parts include the engine; ignition and fuel delivery system; transmission; brakes; frame and suspension system; and seats and accessories. The engine of a motorcycle is suspended within the vehicle frame between the front and rear wheels. Motorcycle engines transform chemical energy from gasoline into mechanical energy by igniting a volatile mixture of fuel and air within a cylinder, causing gases to expand suddenly. More specifically, four successive processes occur in each combustion cycle of a motorcycle engine. During the intake stroke of a piston, air that has been mixed with gasoline vapor in the carburetor is run into the cylinder. During the compression stroke, the intake valve is closed and the air-fuel mixture is compressed. At this point a spark, if properly timed, ignites the air-fuel mixture, causing a rapid increase in pressure and temperature at nearly constant volume. The burning gases expand and force the piston back, which produces the power stroke turning a crankshaft. The crankshaft transforms the energy from the piston into rotary motion via a cam. The rotational force of the engine's crankshaft and cam turns other shafts and gears that eventually cause the rear wheel of the motorcycle to rotate. Finally, during the exhaust stroke, the exhaust valve is opened and the rising piston forces most of the remaining unburned gas and exhaust out of the cylinder. The cycle is repeated after the exhaust valve is closed and the intake valve is reopened.

As discussed, it is important that spark plugs associated with the motorcycle engine spark in a proper firing sequence or timing so as to produce the largest effective output of power. However, it is difficult to adjust timing in conventional motorcycle engines. Timing adjustment is typically done in a motorcycle shop. But there are instances where timing must be adjusted in situations in which a rider and his motorcycle are well away from the convenience of a motorcycle shop. These instances include a change in altitude, the ambient temperature, and fuel type, among other things.

To adjust timing, a shop technician locates the ignition system of a motorcycle, and more particularly, the cam cover on the motorcycle engine. The timer cover is then removed from the cam cover. The screws to which the timing assembly is fixed are loosened. The timing assembly is rotated by the shop technician to adjust the timing. Next, the shop technician moves to the other side of the motorcycle engine and observes a tiny view hole. A timing light is shined, which strobes the view hole so as to allow the shop technician to determine whether there is proper timing. The view hole allows the shop technician to see the flywheel coupled to the crankshaft. There are timing marks on the flywheel. When the timing mark is at the center of the view hole, proper timing has been achieved. If the adjustment fails to provide proper timing, the shop technician has to go back to the other side of the motorcycle engine and make further adjustment to the timing assembly and then repeat the above-identified processing steps.

While the above-process steps are executed, the motorcycle engine has to be kept on while engine oil is spurting out of a view hole. As mentioned above, there are instances, such as during racing or travelling to high altitudes, where access to a motorcycle shop is not possible. However, timing adjustment is still necessary. Thus, there is a need for a system and method for adjusting the timing to cause proper firing sequence to various cylinders of a motorcycle engine while avoiding or mitigating the problems of conventional motorcycle engines.

SUMMARY OF THE INVENTION

In accordance with this invention, a system and method for adjusting timing in motorcycle engines is provided. The system form of the invention includes a timing structure that sits in a cam cover mounted on an engine. The timing structure includes legs to which a sensor assembly is fastened. The timing structure further includes an annular body that includes a first annular member with slits for receiving fasterners to tighten for securing a timing position or to loosen for timing adjustment. The annular body further includes a second annular member that protrudes from the cam cover.

In accordance with further aspects of this invention, the system form of the invention includes an ignition system for a motorcycle engine. The ignition system includes a cam cover with multiple annular chambers. Multiple marks are spaced apart and defined on a neck of the cam cover indicating degrees to which timing adjustments can be made. The ignition system includes a timing structure with annular members that are stored into the multiple annular chambers of the cam cover. One of the annular members protrudes from the cam cover and is adapted for gripping to adjust timing.

In accordance with further aspects of this invention, the method form of the invention includes a method for adjusting the timing of a motorcycle engine. The method comprises loosening fasteners that secure a timing structure to a cam cover. The method further comprises grabbing an annular member of the timing structure that protrudes from the cam cover and rotating the annular member to adjust the timing without looking at a view hole to determine the desired timing adjustment.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

A motorcycle engine's ignition system, such as an ignition system 100, controls the spark that ignites the fuel in a cylinder. The ignitition system 100 routes high-voltage pulses to individual cylinders of a motorcycle engine 102 in the correct sequence and with precise timing. Conventional ignition systems require timing adjustments to be made in a motorcycle shop because certain portions of the motorcycle engine, such as the cam and the view hole, have to be opened up. Various embodiments of the present invention allow timing adjustments to be made externally without the invasive procedures used in a motorcycle shop.

Figure 1:
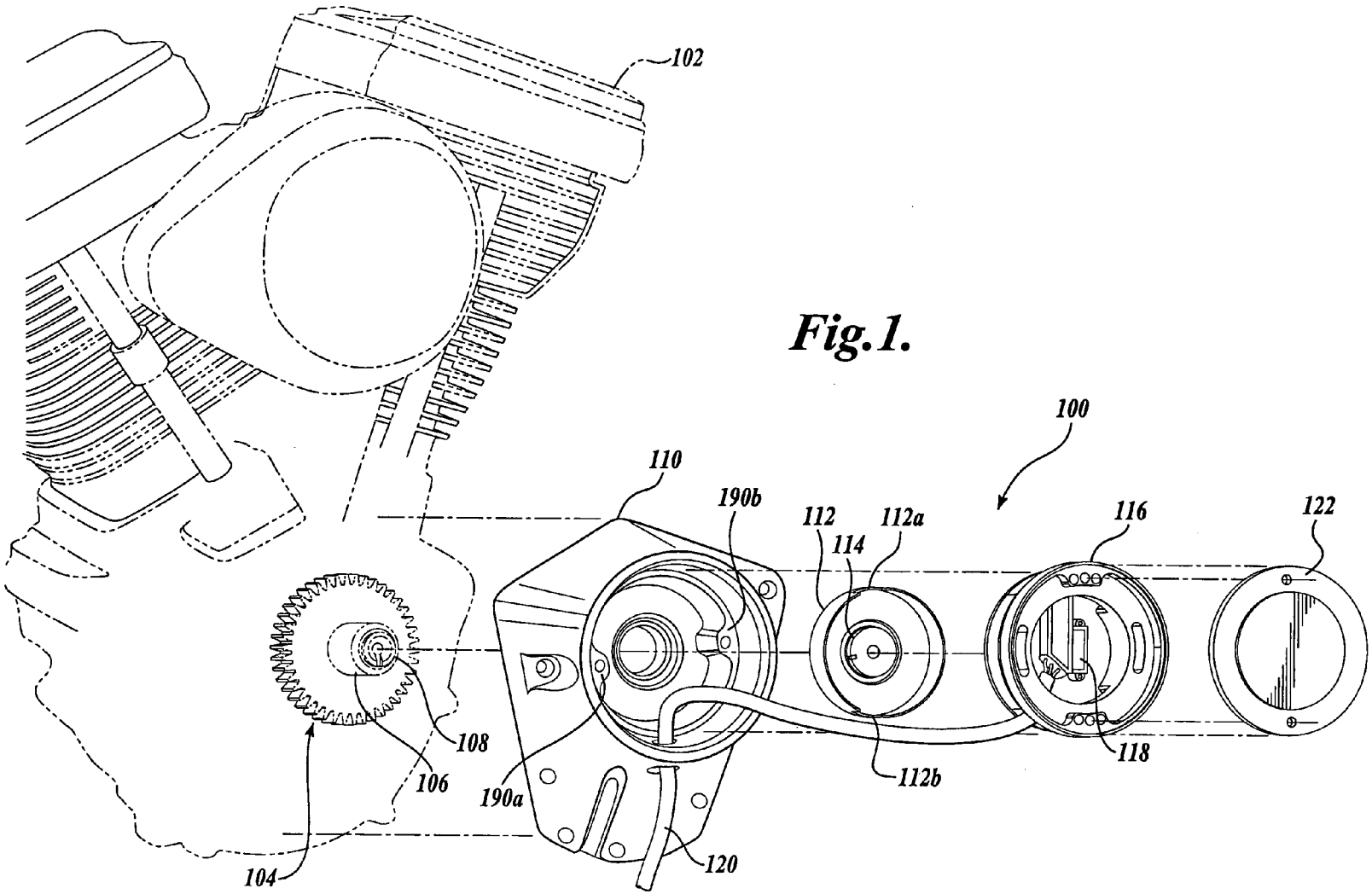
FIG. 1 is an exploded perspective view of an ignition system which includes an exemplary timing structure in accordance with one embodiment of the present invention.

FIG. 1 illustrates the ignition system 100 mountable on a motorcycle engine 102. Seated in the motorcycle engine 102 is a cam 104, which is a cylinder that communicates motion to a follower by means of its edge or a groove cut in its surface. A shaft 106 axially coupled to the cam 104 has a nose 108. The nose 108 of the shaft 106 mates with an orifice defined by a base of one of the chambers of a cam cover 110. The cam cover 110 includes holes 190*a*, 190*b* for receiving fasterners, such as screws, from slits 132*a*, 132*b* of a timing structure 116 to secure the timing structure 116. The cam cover 110 forms part of the ignition system 100, which includes a rotor 112. Axially centered at a base of the rotor 112 is a neck 114 that extends from the base and further defines another orifice through which a fastener can be placed to couple the rotor 112 to the nose 108 of the shaft 106. The rotor 112 includes slots 112*a*, 112*b*, which act to break the magnetic field generated by a sensor assembly 118 and allow the ignition system 100 to direct high-voltage ignition current in a proper firing sequence to the various cylinders of the motorcycle engine 102. The sensor assembly 118 is housed by a timing structure 116, which allows timing to be adjusted externally. The timing structure 116 includes slits 132*a*, 132*b* for receiving fasteners, such as screws, that can be tightened to secure a particular timing position or that can be loosened so that timing adjustment can be made to the ignition system 100 by rotating the timing structure 116 clockwise or counter-clockwise. A bundle of wires 120 electrically coupled to the sensor assembly 118 delivers appropriate electrical signals to initiate the proper firing sequence to the various cylinders of the motorcycle engine 102. A timer cover 122 is secured to the timing structure 116 via screws or other fastening means.

Figure 2:
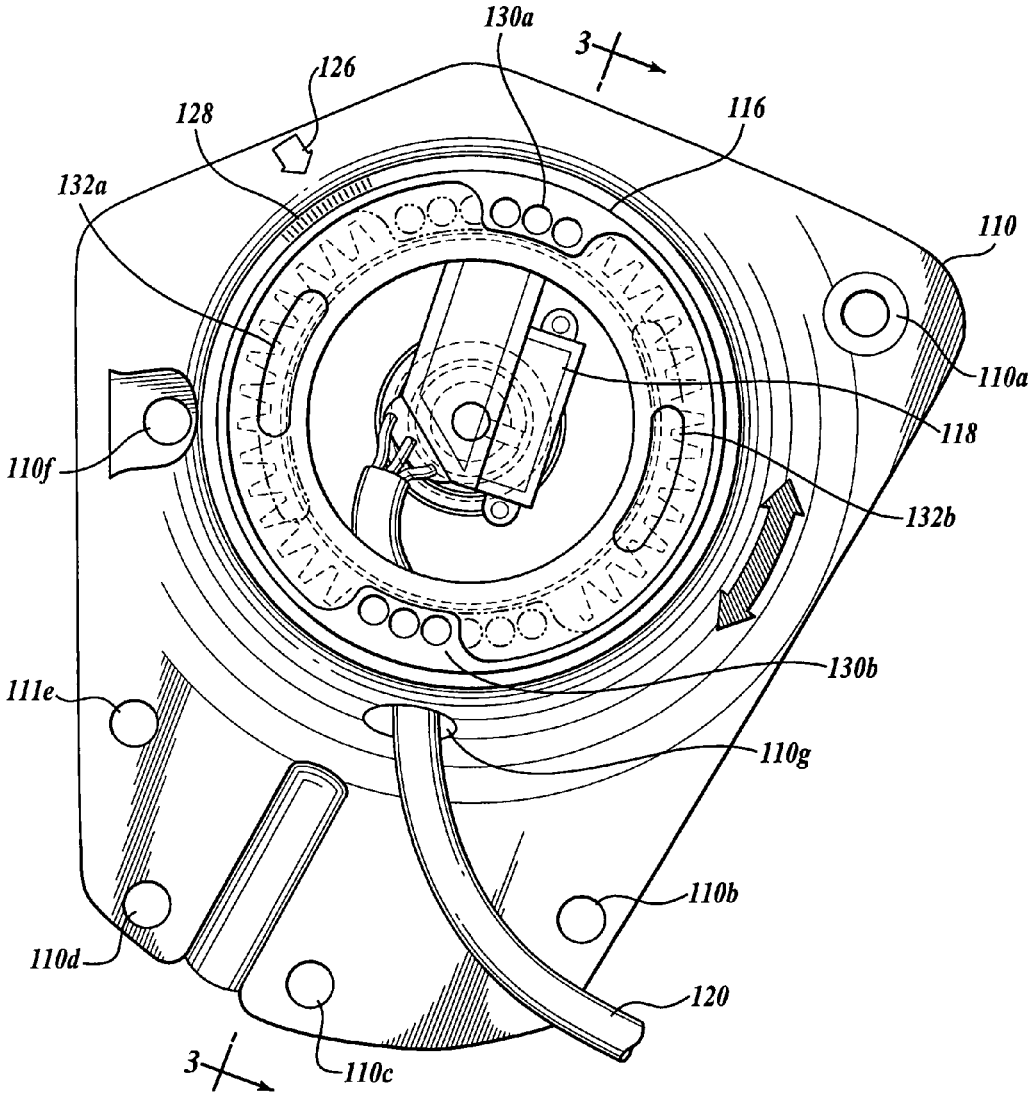
FIG. 2 is a top plan view of an assembled ignition system that includes an exemplary timing structure in accordance with one embodiment of the present invention.

FIG. 2 illustrates the cam cover 110 in greater detail. The cam cover 110 includes numerous bores 110*a*–110*f* of to accommodate screws which fasten the cam cover 110 to the engine 102. A bore 110*g* allows the egress of the bundle of wires 120 from the chambers of the cam cover 110. The timing structure 116 includes sets of holes 130*a*, 130*b* for receiving cover screws to secure the timer cover 122 to the timing structure 116. The timing structure 116 also includes slits 132*a*, 132*b* for receiving fasteners, such as screws, that can be tightened to secure a particular timing position or that can be loosened so that timing adjustments can be made to the ignition system 100 by rotating the timing structure 116 clockwise or counter-clockwise. A set of markers 128 are preferably presented on a neck of the cam cover 110 to indicate various degrees of timing adjustment. Preferably, each marker indicates about two degrees of timing adjustment, but any suitable degree increment may be used. A symbol 126 marks the degree of timing adjustment made. Any suitable symbol 126 can be used, such as a wedge-shaped piercing tip; something resembling an arrow head; or any other designs that are indicative of the position of the timing adjustment.

Figure 3:
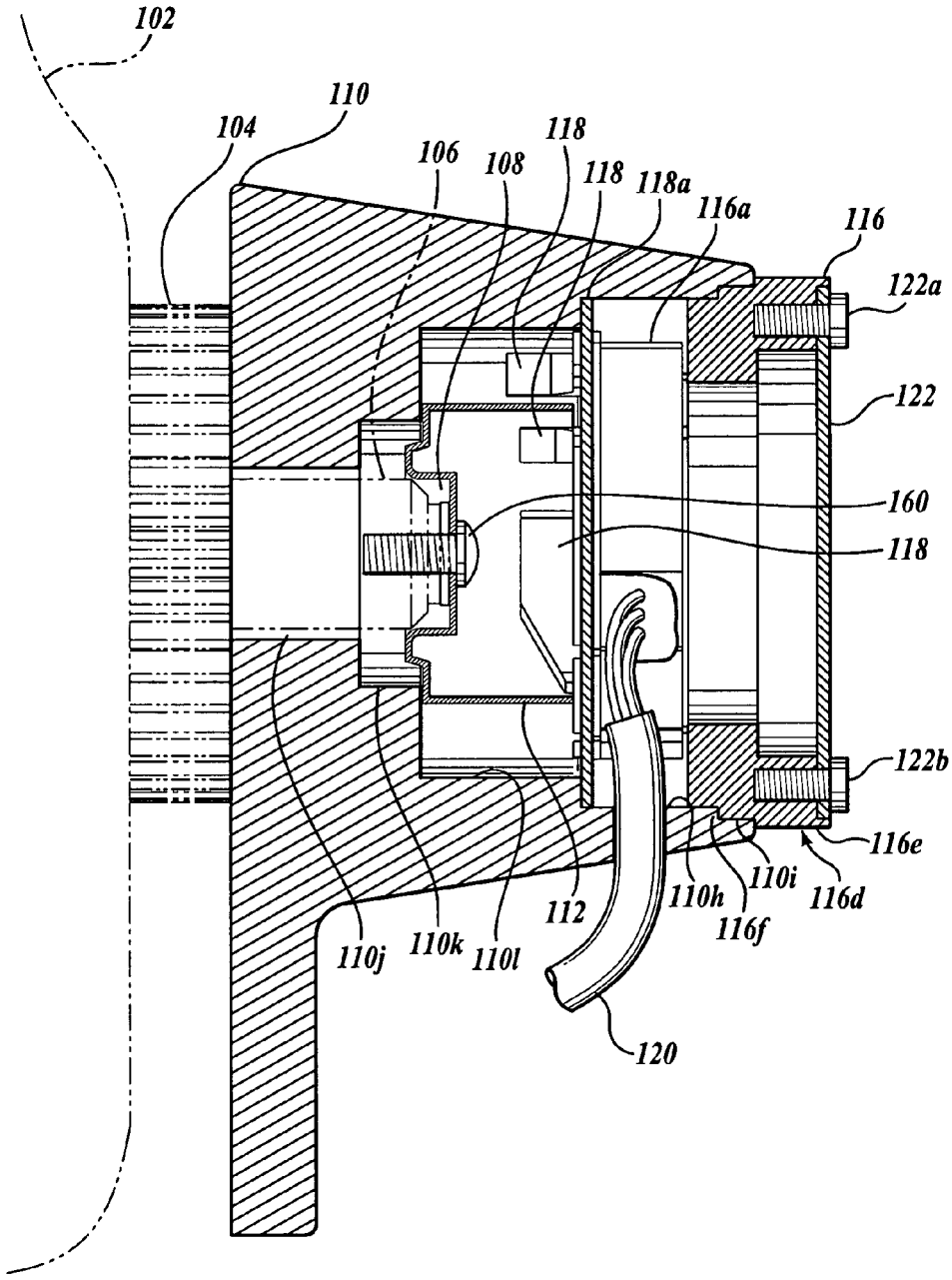
FIG. 3 is a cross-sectional view of an ignition system that includes an exemplary timing structure in accordance with one embodiment of the present invention.

FIG. 3 illustrates a cross-sectional view of the cam cover 110. The shaft 106 is insertable into the orifice of the cam cover 110 defined by annular chambers 110*j*, 110*k*. The rotor 112 is fastened to the nose 108 of the shaft 106 via a screw 160. The rotor 112 is situated in another annular chamber 1101 of the cam cover 110. The rotor 112 rotates with the shaft 106 when the cam 104 turns and the slots 112*a*, 112*b* break the magnetic field generated by the sensor assembly 118. The sensor assembly is mounted on a circular base 118*a*, which sits in an annular chamber 110*h* of the cam cover 110. The timing structure 116 includes multiple legs (one of which is shown as 116*a*) to which the sensor assembly 118 is fastened. The timing structure 116 is further defined by the annular body 116*d* which comprises annular members 116*f*, 116*e*. The annular member 116*f* is seated into the annular chambers 110*h*, 110*i*. The annular member 116*e* of the timing structure 116 sits on the annular lip of the cam cover 110 and is exposed. Two screws 122*a*, 122*b* fasten the timing cover 122 to the timing structure 116.

Figure 4A:
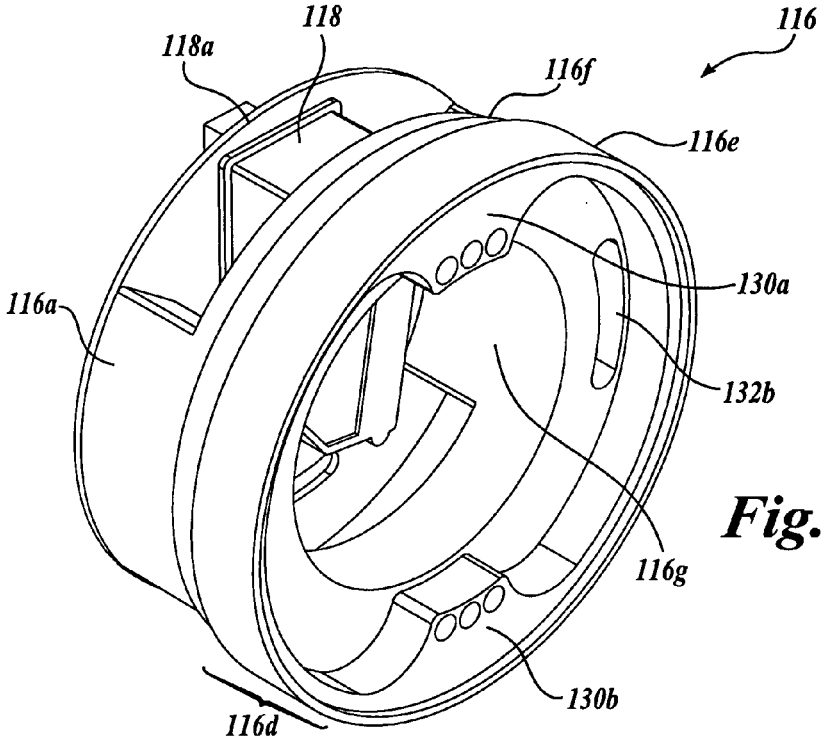
FIGS. 4A–4B are perspective views of an exemplary timing structure in accordance with one embodiment of the present invention.
Figure 4B:
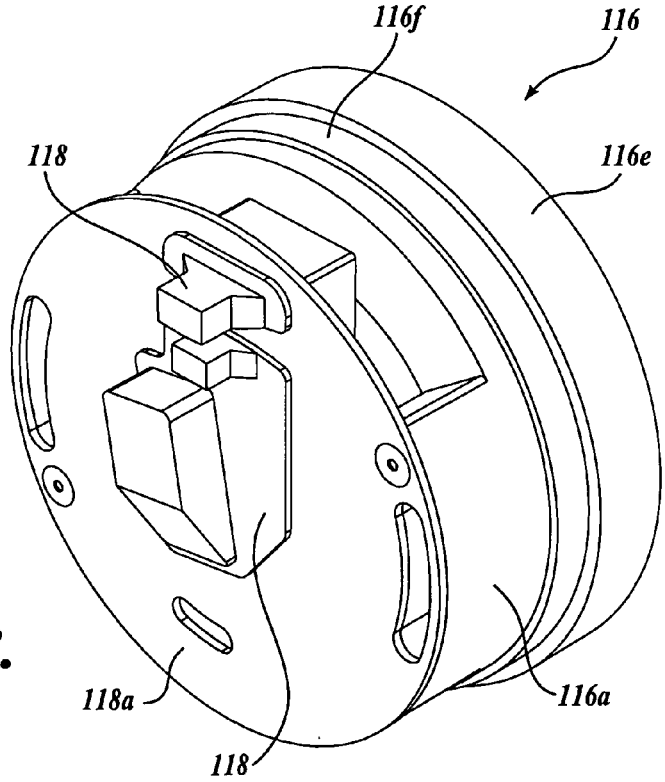

FIGS. 4A–4B illustrate perspective views of the timing structure 116. Another leg 116*g* in addition to the leg 116*a* is shown. In operation, after Easterners are loosened from the slits 132*a*, 132*b*, a user can grab the annular member 116*e* and move it clockwise or counter-clockwise to adjust timing. Any suitable material can be used to create the timing structure 116. One suitable material includes aluminum, another suitable material includes heat resistant plastic, and a further suitable material includes titanium.

Figure 5A:
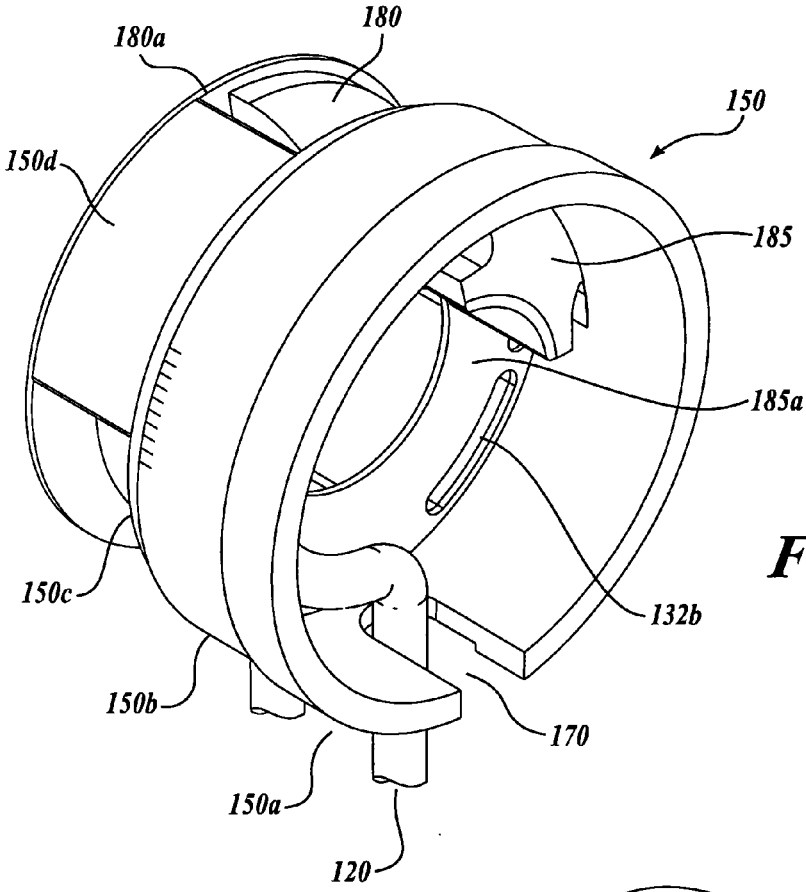
FIGS. 5A–5B are perspective views of an exemplary double timing structure in accordance with one embodiment of the present invention.
Figure 5B:
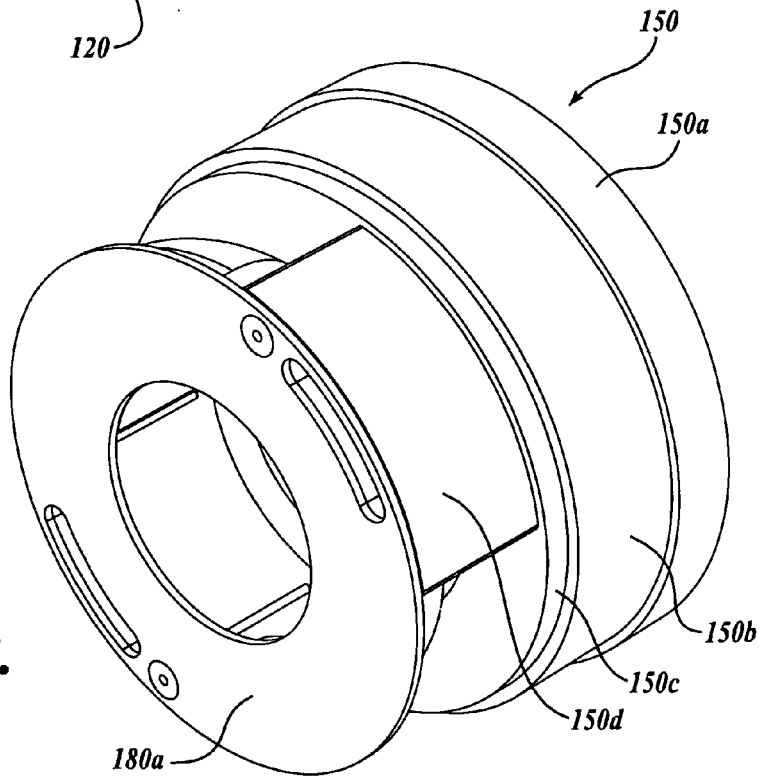

FIGS. 5A–5B illustrate perspective views of another embodiment of a timing structure 150. The timing structure 150 provides dual ignition capability suitable for use in racing motorcycles or motorcycles that use potent fuel mixtures, such as nitro compounds. The timing structure 150 accommodates sensor assemblies 180 (which are secured to a circular base 180*a*) and 185 (which are secured to a circular base 185*a*). The timing structure 150 includes one or more legs 150*d* that stand in the chambers of a cam cover 110. An annular body comprises three annular members 150*a*–150*c*. The annular member 150*c* is seated into various chambers of the cam cover 110. Slots 132*a* (not shown) and slots 132*b* allow fasteners, such as screws, to secure the timing structure 150 into a particular timing position or they can be loosened for adjustment purposes. A hollow 170 is situated over a portion of annular members 150*a*, 150*b*. Annular members 150*a*, 150*b* also sit upon the annular lips of the cam cover 110 and are exposed. In practice, a user would preferably grab the annular member 150*a* of the annular body and turn clockwise or counter-clockwise to achieve the desired timing adjustment.

Various embodiments discussed above allow the timing structure to be manually adjusted but the timing structure can also be automatically adjusted via a servo controllable by the driver while driving. Additionally, the timing structure can be mechanically adjusted while driving through cables connected to a gear structure that communicates with the timing structure to adjust the timing. While the preferred embodiment of the invention has been illustrated and described, it will be appreciated that various changes can be made therein without departing from the spirit and scope of the invention.

What is claimed is:

1. A timing structure seating in a cam cover mounted on an engine, comprising:

legs to which a sensor assembly is fastened; and an annular body that includes a first annular member with slits for receiving fasteners to tighten for securing a timing position or to loosen for timing adjustment, the annular body further including a second annular member that protrudes from the cam cover.

2. The timing structure of claim 1, wherein the sensor assembly is secured on a circular base and the circular base is fastened to the legs.

3. The timing structure of claim 1, wherein the second annular member includes two sets of holes adapted to receive fasteners to secure a timer cover.

4. The timing structure of claim 1, wherein the annular body further includes another sensor assembly being secured to the second annular member.

5. The timing structure of claim 1, wherein the annular body further includes a third annular member, the third annular member and the second annular member protruding from the cam cover.

6. An ignition system for a motorcycle engine, comprising:

a cam cover with multiple annular chambers, multiple marks being spaced apart and defined on a neck of the cam cover indicating degrees to which timing adjustment can be made; and a timing structure with annular members that are seated into the multiple annular chambers of the cam cover, one of the annular members protruding from the cam cover and being adapted for gripping to adjust timing.

7. The ignition system of claim 6, wherein the timing structure further comprises legs to which a sensor assembly is fastened.

8. The ignition system of claim 7, wherein the timing structure further comprises an annular body that includes annular members, a first annular member with slits for receiving fasteners to tighten for securing a timing position or to loosen for timing adjustment, the annular body further including a second annular member that protrudes from the cam cover.

9. The ignition system of claim 8, wherein the annular body further includes another sensor assembly being secured to the second annular member.

10. The ignition system of claim 9, wherein the annular body further includes a third annular member, the third annular member and the second annular member protruding from the cam cover.

11. A method for adjusting the timing of a motorcycle engine, comprising:

loosening fasteners that secure a timing structure to a cam cover; and grabbing an annular member of the timing structure that protrudes from the cam cover and rotating the annular member to adjust the timing without looking at a view hole to determine desired timing adjustment.

12. The method of claim 11, further comprising tightening the fasteners to secure the timing structure to a particular timing adjustment.

13. The method of claim 11, wherein rotating includes rotating clockwise by an increment marked by markers on a neck of the cam cover, each increment being indicative of about 2 degrees of timing adjustment.

14. The method of claim 11, wherein rotating includes rotating counter-clockwise by an increment marked by markers on a neck of the cam cover, each increment being indicative of about 2 degrees of timing adjustment.

15. The method of claim 11, wherein the timing structure is adapted to retain multiple sensor assemblies.

* * * * *

UNITED STATES PATENT AND TRADEMARK OFFICE

CERTIFICATE OF CORRECTION

PATENT NO. : 7,152,562 B2
APPLICATION NO. : 11/142050
DATED : December 26, 2006
INVENTOR(S) : R. Anderson It is certified that error appears in the above-identified patent and that said Letters Patent is hereby corrected as shown below:

| COLUMN | LINE | ERROR |
|---|---|---|
| 5 (Claim 6, line 8) | 37 | "chambers" should read --members-- |

Signed and Sealed this

First Day of May, 2007

JON W. DUDAS
*Director of the United States Patent and Trademark Office*